US005657044A

United States Patent [19]

Makino

[11] Patent Number: 5,657,044

[45] Date of Patent: Aug. 12, 1997

[54] LIQUID CRYSTAL DISPLAY CONVERTER

[75] Inventor: Toshihiko Makino, Sagamihara, Japan

[73] Assignee: Ricoh Company, Ltd., Tokyo, Japan

[21] Appl. No.: 338,185

[22] Filed: Nov. 9, 1994

[30] Foreign Application Priority Data

Nov. 19, 1993 [JP] Japan ..... 5-312813

[51] Int. Cl.[6] ..... G09G 3/36

[52] U.S. Cl. ..... 345/103; 345/98

[58] Field of Search ..... 345/87, 98, 99, 345/100, 103

[56] References Cited

U.S. PATENT DOCUMENTS

| | | | |
|---|---|---|---|
| 4,630,122 | 12/1986 | Morokawa | 345/100 |
| 4,745,485 | 5/1988 | Iwasaki | 345/98 |
| 4,908,710 | 3/1990 | Wakai et al. | 345/103 |
| 5,512,915 | 4/1996 | Leroux | 345/98 |

*Primary Examiner*—Mark R. Powell
*Assistant Examiner*—Matthew Luu
*Attorney, Agent, or Firm*—Oblon, Spivak, McClelland, Maier & Neustadt, P.C.

[57] ABSTRACT

A liquid crystal display converter has at least two frame memories. An alternative switching operation is performed by controlling the operations of an address generating circuit and a data switching circuit on the basis of an output from a frame counter. In the alternative switching operation, when one of the frame memories performs a writing operation, the other frame memory performs a reading operation. In contrast to this, when one of the frame memories performs a reading operation in the alternative switching operation, the other frame memory performs a writing operation. In this construction, the number of access operations of the frame memories is reduced so that the liquid crystal display converter can be constructed by a memory relatively cheaply manufactured without using any high speed memory. Accordingly, price of the liquid crystal display converter can be reduced.

18 Claims, 9 Drawing Sheets

FRAME MEMORY

FIG. 11a
FIG. 11b
FIG. 11c
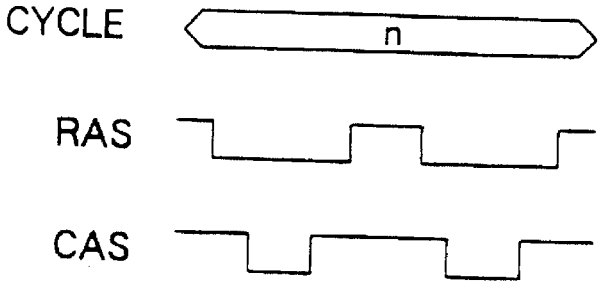
FIG. 11d
FIG. 11e
FIG. 11f
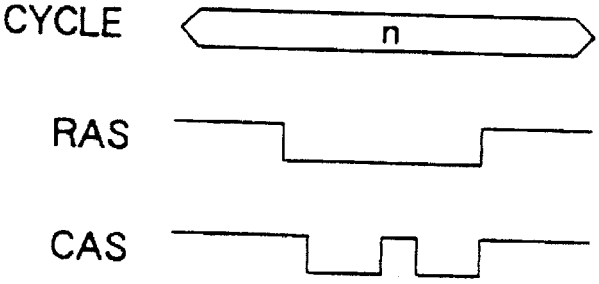

LIQUID CRYSTAL DISPLAY CONVERTER

BACKGROUND OF THE INVENTION

1. Field of the Invention

The present invention relates to a display converter of a liquid crystal display panel used as a display unit in various kinds of data processors such as a word processor, a work station, etc. More particularly, the present invention relates to an improvement of a liquid crystal display converter for a liquid crystal display panel of a so-called two-divisional driving system in which the liquid crystal display panel is operated by dividing a display screen into a plurality of divisional screens such as two divisional screens, etc. Concretely, the present invention relates to a liquid crystal display converter in which a high speed display is performed without using any high speed frame memories so that a cost of the liquid crystal display converter can be reduced.

2. Description of the Related Art

A liquid crystal display panel as a display unit generally tends to be used in many cases in various kinds of data processors such as a word processor, a work station, a desk top publishing (DTP) device, etc. The liquid crystal display panel is called an LCD in the following description.

In this case, a liquid crystal display converter is used as a display controller for the LCD so as to cope with a situation in which no change in software is required. The liquid crystal display converter has a function for converting a display signal of the display unit such as a cathode ray tube (CRT) generally Used to a display signal for the LCD.

This general liquid crystal display converter generates data for a display by changing the display signal from the display controller in a data processor to the display signal for the LCD.

The liquid crystal display converter generally used will next be explained with reference to FIG. 1.

FIG. 1 is a functional block diagram showing one example of a main construction of the general liquid crystal display converter. In FIG. 1, reference numerals 1, 2 and 3 respectively designate a display controller, a write address generating section and an interface section for a frame memory. Reference numerals 4, 5 and 6 respectively designate an LCD control section, a read address generating section and an address generating section of the frame memory. Reference numerals 7, 8 and 9 respectively designate an interface section for an LCD, the frame memory and the LCD.

As shown in FIG. 1, the general liquid crystal display converter has one frame memory 8. Display data outputted from the display controller 1 are converted to data for the frame memory by the interface section 5 for the frame memory and are then written to this frame memory 8.

A write address at this time is generated by the write address generating section 2 by using a control signal outputted from the display controller 1. This write address is then transmitted to this frame memory 8 through the frame memory address generating section 6.

The display data to be transmitted to the LCD 9 are read out of the frame memory 8 and are converted to data for the LCD by the interface section 7 for the LCD. These converted data are transmitted to the LCD 9.

In this case, a read address is generated by the read address generating section 5 by using a control signal outputted from the LCD control section 4 for converting a synchronous signal from the display controller 1 to a control signal for the LCD. This read address is then transmitted to the frame memory 8 through the frame memory address generating section 6.

The display controller 1 is constructed as shown in FIG. 2.

FIG. 2 is a functional block diagram showing one example of a detailed construction of the display controller 1 shown in FIG. 1. In FIG. 2, reference numerals 10, 11, 12 and 13 respectively designate a central processing unit (CPU), a display circuit, a video RAM and a display unit. As shown in FIG. 2, the video RAM 12 in the display controller 1 shown in FIG. 1 holds data for a display from the central processing unit (CPU) 10. The display circuit 11 in the display controller 1 controls writing and reading operations of this video RAM 12 and generates a control signal transmitted to the display unit.

In the general liquid crystal display converter, data required for a display are outputted to the LCD 9 by the above construction and operation so that a picture image is visually displayed on the screen.

A so-called two-divisional driving system is used in the LCD. In this driving system, for example, the screen of the LCD is divided into two divisional screens composed of upper and lower divisional screens in view of the relation of afterimage characteristics, etc. when the screen is especially large-sized. The LCD is operated every divisional screen in this driving system.

If this driving system is used, it is possible to provide a screen having a high grade with reduced flicker even when the screen of the LCD is large-sized.

In this case, the frame memory 8 holds only image data corresponding to one screen in the general two-divisional driving system as already mentioned above. Therefore, in the frame memory 8, two reading operations are required with respect to one writing operation.

This relation will next be explained with reference to FIGS. 3*a* through 3*e*.

FIGS. 3*a* through 3*e* is a timing chart for explaining one example of the writing and reading operations of data with respect to the frame memory in the liquid crystal display panel of the general two-divisional driving system.

In FIGS. 3*a* through 3*e*, for example, a cycle shows an access period provided when an access operation with respect to each of addresses on the upper and lower divisional screens is performed.

In this example, cycles n−1, n and n+1 are shown.

Reading data m shows n-th data m on the lower divisional screen corresponding to n-th data n on the upper divisional screen.

Upper data of the LCD shown in FIGS. 3*a* through 3*e* are data displayed on the upper divisional screen of the two divided screens. Lower data of the LCD shown in FIGS. 3*a* through 3*e* are data displayed on the lower divisional screen of the two divided screens. FIGS. 3*a* through 3*e* shows output timings of these upper and lower data.

As shown by the timing chart of FIGS. 3*a* through 3*e*, when certain data on the screen such as n-th data are accessed, writing data (n) are written with respect to one cycle of the LCD. Thereafter, reading data (n) are read as data for the upper divisional screen of the LCD set to the upper data of the LCD in FIGS. 3*a* through 3*e*. Next, it is necessary to read reading data (m) as data for the lower divisional screen of the LCD set to the lower data of the LCD in FIGS. 3*a* through 3*e*. Accordingly, three access operations are performed with respect to the frame memory 8 to display a picture image on one screen.

If such operations are performed, it is possible to display a picture image having a high quality and no flicker even when the screen of the liquid crystal display panel (LCD) is large-sized.

For example, a known integrated circuit (IC) of an HD66840 type manufactured by Hitachi Co., Ltd. in Japan has such a function.

As mentioned above, the LCD of the two-divisional driving system is generally known and an integrated circuit (IC) for this LCD is also known.

However, a double reading operation is performed with respect to the frame memory 8 in the LCD of the two-divisional driving system. Therefore, it is necessary to terminate the reading operation every divisional screen within a time half that for a writing operation.

Accordingly, it is necessary to use a high speed frame memory and thereby the cost of the liquid crystal display converter is increased.

In a memory having a single port, it is necessary to operate this memory at a high speed. Accordingly, it is considered to use a memory having a dual port composed of a random access port and a serial access port.

The reading and writing operations can be simultaneously performed in accordance with a method for using this memory having the dual port. Accordingly, a predetermined object of the liquid crystal display converter can be achieved without using any high speed memory.

However, cost of the dual port memory is high by about several times in comparison with the single port memory at the same operating speed so that price of the liquid crystal display converter is similarly increased.

SUMMARY OF THE INVENTION

It is therefore an object of the present invention to provide a liquid crystal display converter for solving the above general problems in which cost of the entire liquid crystal display converter is increased since an expensive high speed memory such as a high speed single port memory or a high speed dual port memory is required if a two-divisional driving system is used in the liquid crystal display converter having one frame memory. Namely, the object of the present invention is to provide a liquid crystal display converter in which a high quality display is performed and cost of the liquid crystal display converter can be reduced by using only a frame memory at a low price similar to that in the general liquid crystal display converter even when the screen of a liquid crystal display panel is large-sized.

In accordance with a first construction of the present invention, the above object can be achieved by a liquid crystal display converter in a liquid crystal display unit having a display panel having divided display regions; the liquid crystal display converter comprising at least two frame memories having an address space corresponding to one screen; a frame counter for counting the number of displays on the screen of the liquid crystal display unit; an address generating circuit for generating an address of each of the at least two frame memories; and a data switching circuit for controlling data from each of the frame memories; the liquid crystal display converter being constructed such that an alternative switching operation is performed by controlling operations of the address generating circuit and the data switching circuit on the basis of an output from the frame counter. The alternative switching operation is set such that, when one of the frame memories performs a writing operation, the other frame memory performs a reading operation; and when one of the frame memories performs a reading operation, the other frame memory performs a writing operation.

In accordance With a second construction of the present invention, the liquid crystal display converter further comprises an address converting circuit for converting a write address such that respective data corresponding to the same position between the divided display regions are written to adjacent addresses of the frame memories; and an operation of the address converting circuit is controlled such that the adjacent addresses are continuously read at a reading time of the frame memories.

In the first construction of the present invention, at least two frame memories are used and the liquid crystal display converter is constructed such that writing and reading operations of data for a display are independently performed. Accordingly, a high image quality display can be obtained without using any expensive dual port memory, etc. operated at a high speed even in a two-divisional driving system in which the liquid crystal display unit is operated by dividing the screen into two divisional screens composed of upper and lower divisional screens in an LCD especially having a large-sized screen.

In the second construction of the present invention, an operation of the liquid crystal display converter is controlled such that respective data corresponding to the same position between the divided display regions are written to adjacent addresses of the frame memories. The adjacent addresses are continuously read from the frame memories at a reading time of data for a display.

When the liquid crystal display converter of the present invention is used in an information processor, the above effects of the present invention can be also obtained.

Further objects and advantages of the present invention will be apparent from the following description of the preferred embodiments of the present invention as illustrated in the accompanying drawings.

BRIEF DESCRIPTION OF THE DRAWINGS

each of FIGS. 11*a* through 11*f* is a timing chart showing operational timings of the frame memory shown in FIG. 10.

DESCRIPTION OF THE PREFERRED EMBODIMENTS

The preferred embodiments of a liquid crystal display converter in the present invention will next be described in detail with reference to the accompanying drawings.

[Embodiment 1]

An embodiment 1 of the present invention corresponds to a first construction of the present invention and also relates to a second construction of the present invention.

Figure 1:
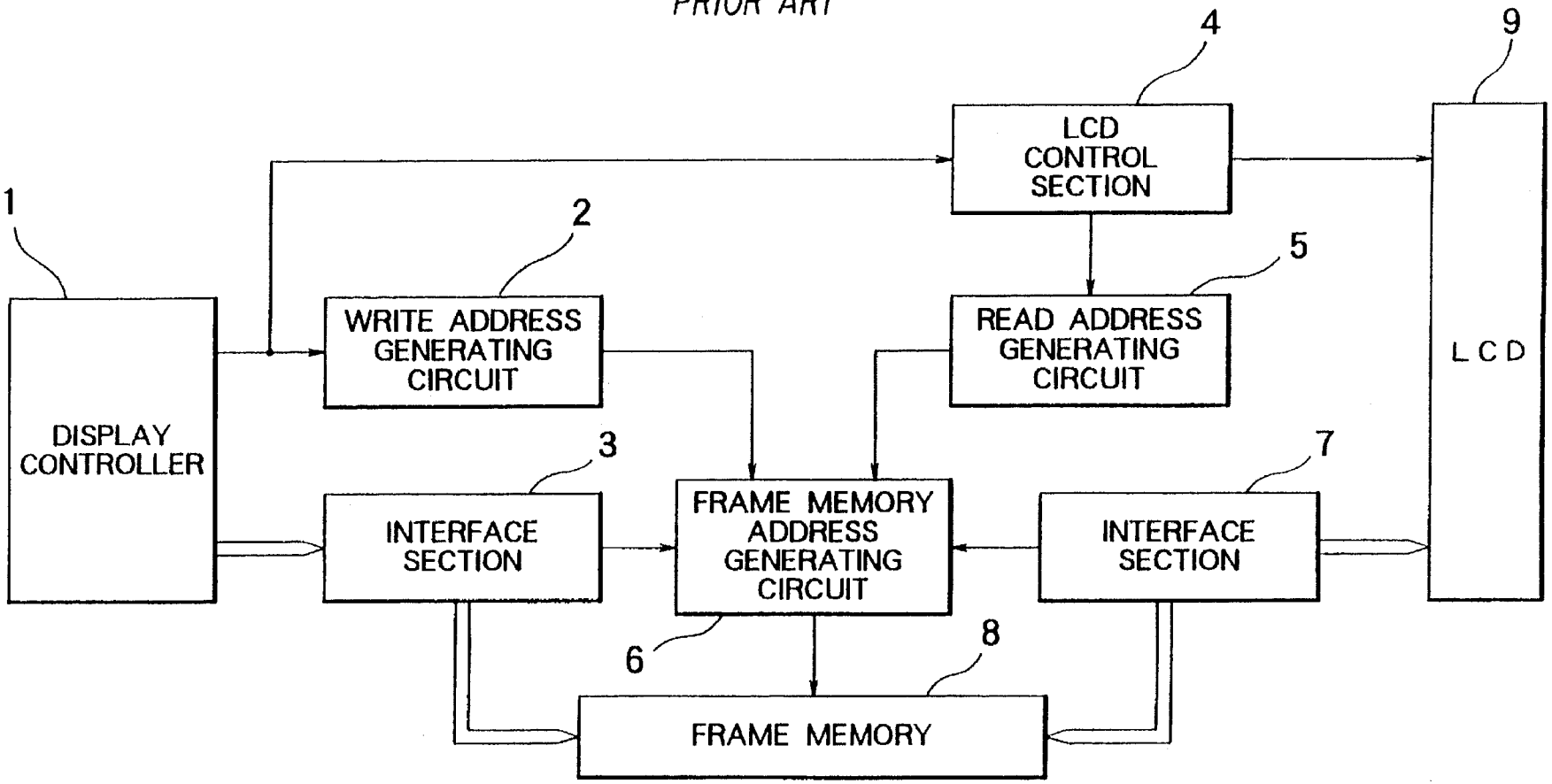
FIG. 1 PRIOR ART
FIG. 1 is a functional block diagram showing one example of the main construction of a general liquid crystal diagram converter.
Figure 2:
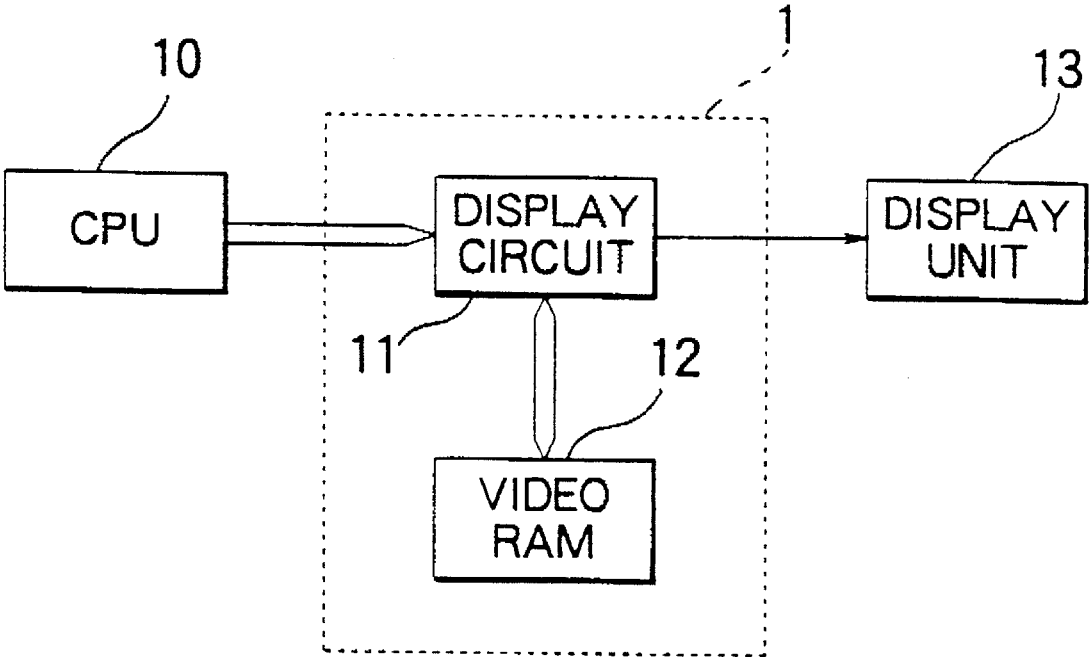
FIG. 2 PRIOR ART
FIG. 2 is a functional block diagram showing one example of the detailed construction of a display controller 1 shown in FIG. 1.
Figures 3A, 3B, 3C, 3D, 3E:
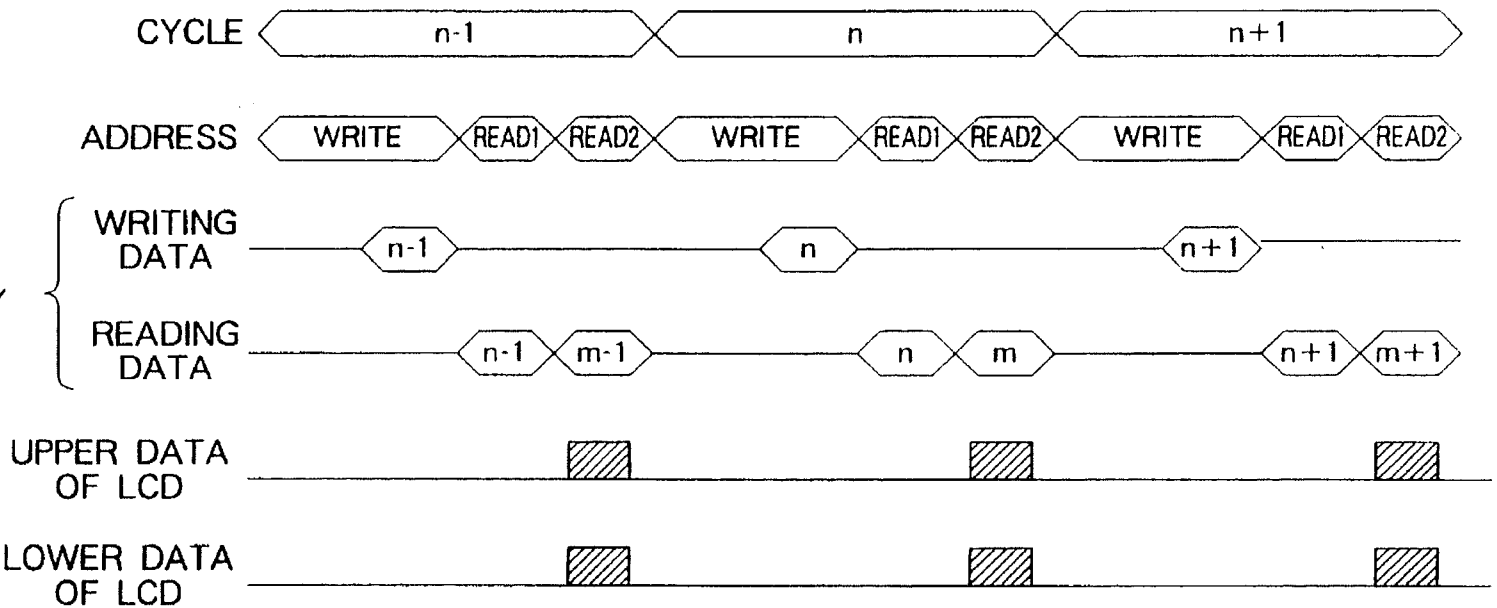
FIG. 3a PRIOR ART
FIG. 3b PRIOR ART
FIG. 3c PRIOR ART
FIG. 3d PRIOR ART
FIG. 3e PRIOR ART
FIGS. 3*a* through 3*e* is a timing chart for explaining one example of writing and reading operations of data with respect to a frame memory of a liquid crystal display panel in a general two-divisional driving system.
Figure 4:
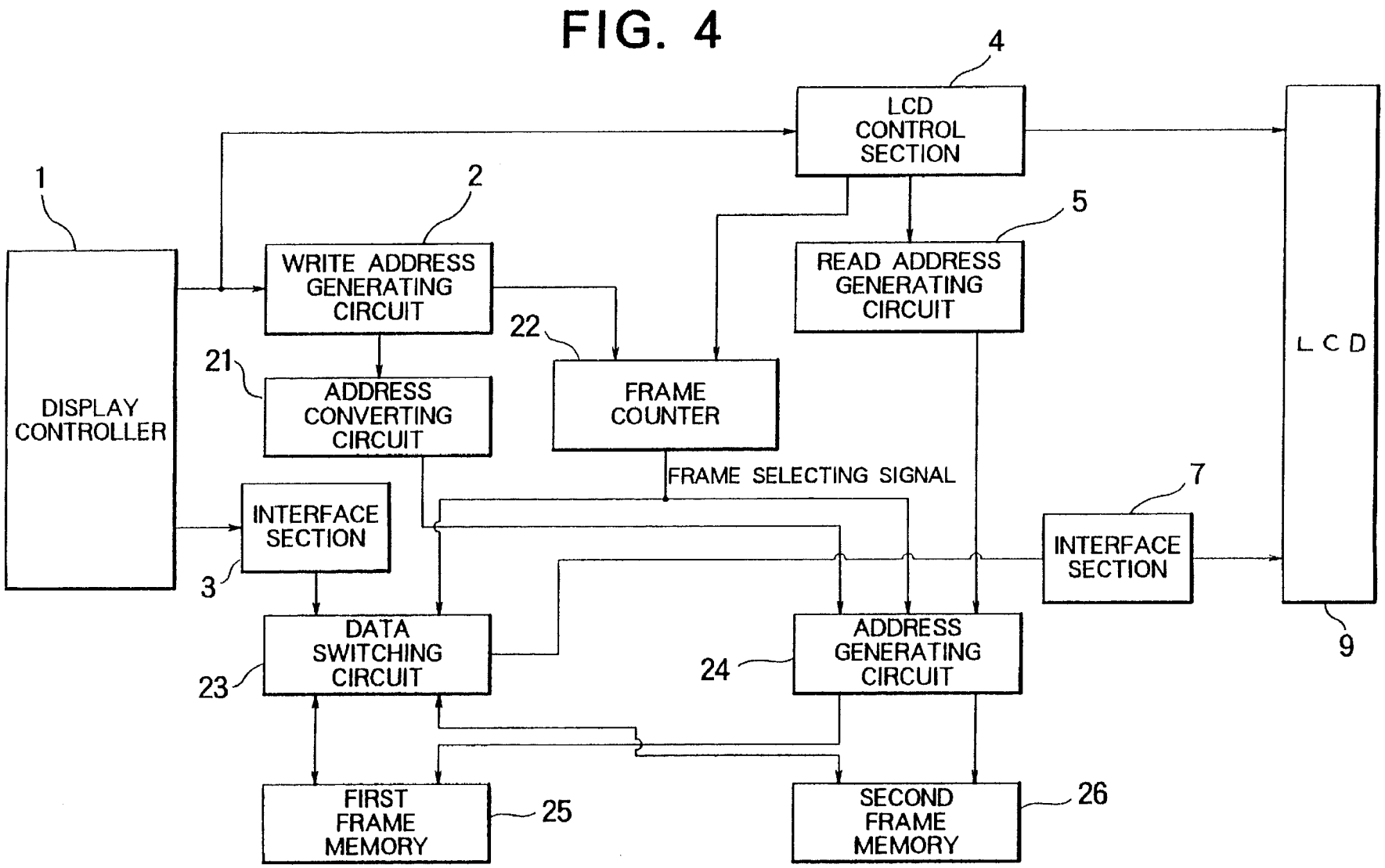
FIG. 4 is a functional block diagram showing the main construction of a liquid crystal display converter in accordance with one embodiment of the present invention.

FIG. 4 is a functional block diagram showing the main construction of a liquid crystal display converter in accordance with this embodiment 1 of the present invention. Reference numerals shown in FIG. 4 are similar to those in FIG. 1. Namely, reference numerals 21, 22 and 23 respectively designate an address converting circuit, a frame counter and a data switching circuit. Reference numerals 24, 25 and 26 respectively designate an address generating circuit, a first frame memory and a second frame memory.

A circuit block shown by reference numerals 21 to 26 is added to the liquid crystal display converter of the present invention shown in FIG. 4.

Firstly, the first frame memory 25 and the second frame memory 26 are arranged as at least two frame memories having an address space corresponding to one screen.

Secondly, the frame counter 22 counts the number of displays on the screen of a liquid crystal display unit.

Thirdly, the address generating circuit 24 generates an address of each of the two frame memories composed of the first frame memory 25 and the second frame memory 26. Fourthly, the data switching circuit 23 controls data from the two frame memories 25 and 26.

The address converting circuit 21 fifthly added to the liquid crystal display converter relates to the second construction of the present invention. Therefore, a detailed explanation of this address converting circuit 21 will be described later. A construction and an operation of the liquid crystal display converter except for the address converting circuit 21 will next be explained.

The frame counter 22 counts a pulse signal outputted from an LCD control section 4 every one screen. The frame counter 22 outputs a frame selecting signal to each of the address generating circuit 24 and the data switching circuit 23. This frame selecting signal shows value "0" in the case of an odd screen and shows value "1" in the case of an even screen.

Each of the first frame memory 25 and the second frame memory 26 has an address space corresponding to at least one screen. As shown by the timing chart of FIG. 6 described later, when an operating mode of the first frame memory 25 is set to a reading mode, an operating mode of the second frame memory 26 is set to a writing mode on the basis of the frame selecting signal transmitted from the frame counter 22. In the next frame, the operating mode of the second frame memory 26 is set to a reading mode when the operating mode of the first frame memory 25 is set to a writing mode.

Here, the frame means a display on one screen of an LCD 9.

Figure 5:
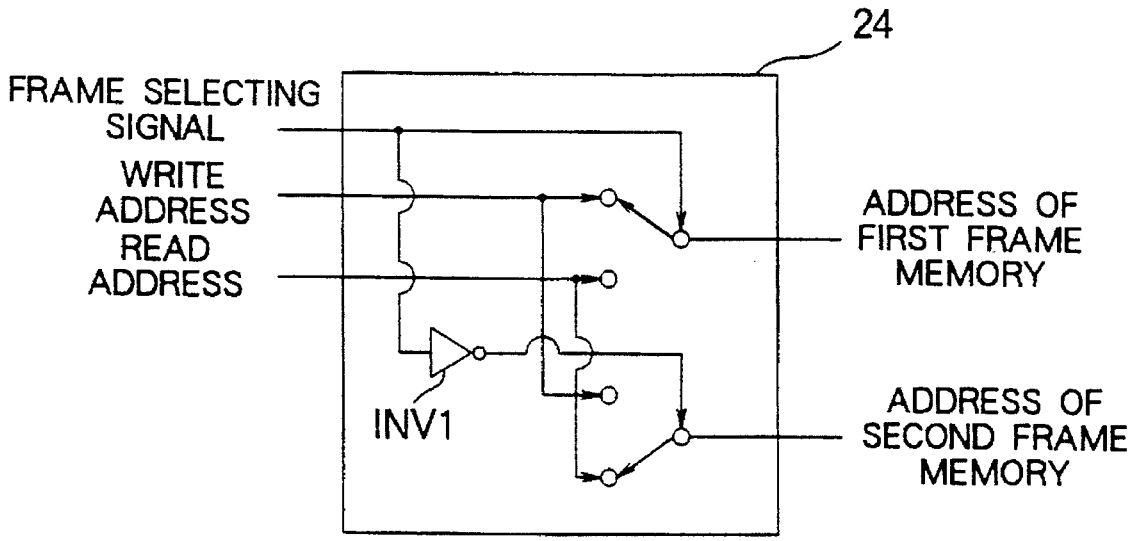
FIG. 5 is a view showing one embodiment of the detailed construction of an address generating circuit 24 arranged in the liquid crystal display converter of the present invention shown in FIG. 4.

FIG. 5 is a view showing one embodiment of a detailed construction of the address generating circuit 24 arranged in the liquid crystal display converter of the present invention shown in FIG. 4. In FIG. 5, INV1 shows an inverter.

As shown in FIG. 5, the address generating circuit 24 has a function for switching writing and reading addresses of the first frame memory 25 by the frame selecting signal transmitted from the frame counter 22.

Similarly, the address generating circuit 24 has a function for switching writing and reading addresses of the second frame memory 26.

In this case, phases of the frame selecting signals transmitted to the respective frame memories 25 and 26 are set to be reverse to each other by the inverter INV1 with respect to addresses of the first frame memory 25 and the second frame memory 26 at the same time point. Accordingly, when one of the first and second frame memories shows a writing address, the other shows a reading address. In contrast to this, when one of the first and second frame memories shows a reading address, the other shows a writing address.

Figure 6:
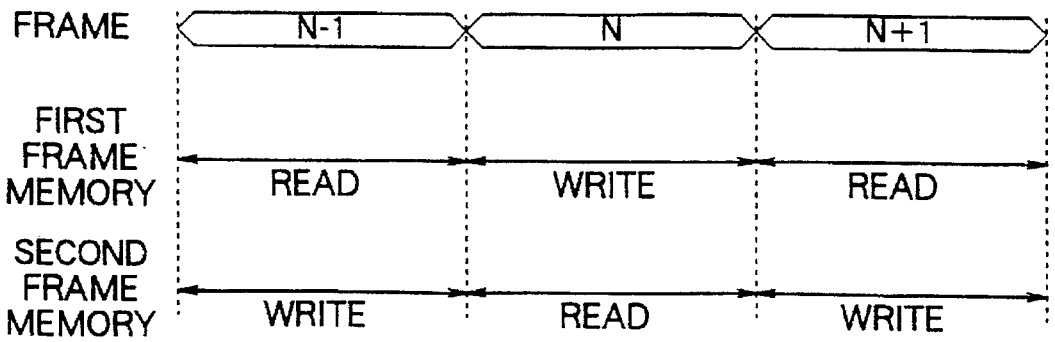
FIG. 6 is a timing chart showing a display switching operation every divisional screen in the liquid crystal display converter of the present invention.

The above operation is shown by the timing chart of FIG. 6.

FIG. 6 is a timing chart showing a display switching operation every screen in the liquid crystal display converter of the present invention.

In FIG. 6, a frame means a display on one screen of the LCD 9 and frames N−1, N, N+1 are shown.

In the case of frame N shown in FIG. 6, operations of the first frame memory 25 and the second frame memory 26 are respectively set to writing and reading operations.

These writing and reading operations are switched by the data switching circuit 23 shown in FIG. 4.

In the case of the next frame (N+1), the operations of the first frame memory 25 and the second frame memory 26 are respectively switched to reading and writing operations.

Figure 7:
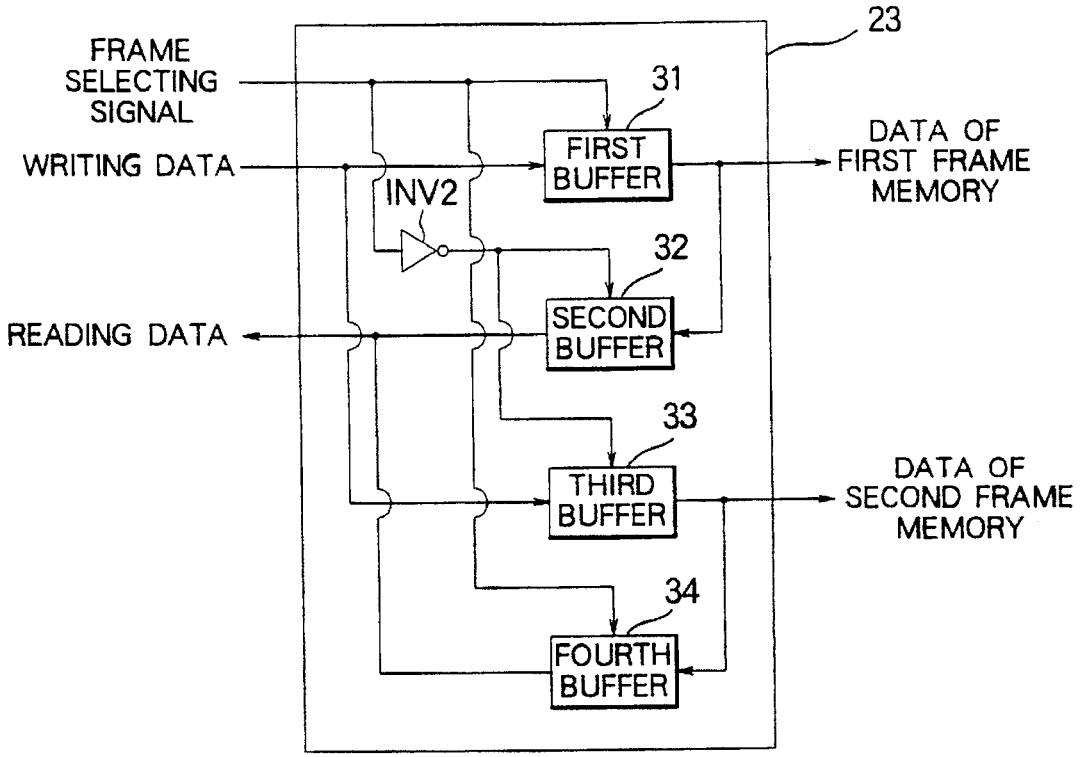
FIG. 7 is a view showing one embodiment of the detailed construction of a data switching circuit 23 arranged in the liquid-crystal display converter of the present invention shown in FIG. 4.

FIG. 7 is a view showing one embodiment of a detailed construction of the data switching circuit 23 arranged in the liquid crystal display converter of the present invention shown in FIG. 4. in FIG. 7, reference numerals 31, 32 and 33 respectively designate a first buffer, a second buffer and a third buffer. Reference numerals 34 and INV2 respectively designate a fourth buffer and an inverter.

As shown in FIG. 7, the data switching circuit 23 selects by the frame selecting signal transmitted from the frame counter 22 that data of the first frame memory 25 are equal to writing or reading data.

Similarly, the data switching circuit 23 selects that data of the second frame memory 26 are equal to writing or reading data.

Namely, when data of the first frame memory 25 are equal to writing data, the first buffer is validated so that the writing data are transmitted to the first frame memory 25 and the second buffer 32 is invalidated by the inverter INV2. Accordingly, no reading data are outputted from the second buffer 32.

At this time point, data of the second frame memory 26 are read so that the fourth buffer 34 is validated. Accordingly, the data of the second frame memory 26 are equal to reading data and the third buffer 33 is invalidated. Accordingly, no data are outputted from this third buffer 33 to the second frame memory 26.

Figure 8A:
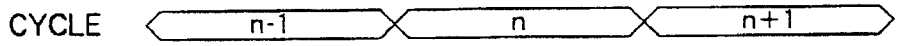
FIGS 8*a*, 8*b* and 8*c* is a timing chart showing a display switching operation every screen address in the liquid crystal display converter of the present invention.
Figure 8B:
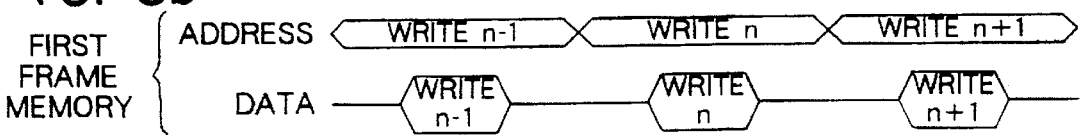
Figure 8C:
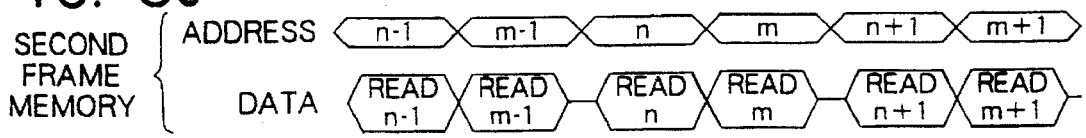

FIGS. 8*a*, 8*b*, and 8*c* is a timing chart showing a display switching operation every screen address in the liquid crystal display converter of the present invention. Signal waveforms shown in FIGS. 8*a*, 8*b* and 8*c* are respectively similar to those in FIG. 3*a* through 3*e*.

As already explained in association with FIG. 4, the liquid crystal display converter of the present invention has two memories composed of the first frame memory 25 and the second frame memory 26 as frame memories having an address space corresponding to one screen.

The respective frame memories 25 and 26 independently perform writing and reading operations.

Accordingly, the timing chart of FIGS. 8*a*, 8*b* and 8*c* shows operational timings of the first frame memory 25 and the second frame memory 26.

The first frame memory 25 and the second frame memory 26 respectively perform the writing and reading operations in the case of frame N shown in FIG. 6.

A cycle shown in FIGS. 8*a*, 8*b* and 8*c* also means an access period provided when an access operation with respect to each of addresses on the screen is performed.

The first frame memory 25 has one address every cycle to perform one writing operation to each of the addresses every cycle.

The second frame memory 26 requires data on upper and lower divisional screens in one cycle. Accordingly, the second frame memory 26 has two addresses and data every cycle.

As can be clearly seen from the comparison of "FIGS. 8*a* through 8*c* and FIGS. 3*a* through 3*e*"; showing the general liquid crystal display converter, only one writing operation or two reading operations are required every cycle in the liquid crystal display converter of the present invention shown in FIGS. 8*a*, 8*b* and 8*c*.

Accordingly, it is not necessary to use an expensive frame memory operated at a high speed.

In particular, the LCD of a color system tends to be recently used in many cases. In this color system, three color data of red, green and blue are required as display data.

Therefore, it is necessary to process display data three times within the same time by a simple calculation in comparison with the LCD of a monochromatic system.

However, as shown in FIGS. 8*a*, 8*b* and 8*c*, the first frame memory 25 and the second frame memory 26 can be independently operated in the liquid crystal display converter of the present invention. Accordingly, a transfer speed of data is increased and a cyclic time is shortened so that it is very effective to use the liquid crystal display converter having the first construction of the present invention.

[Embodiment 2]

A liquid crystal display converter in accordance with a second embodiment of the present invention will next be explained.

This embodiment corresponds to a second construction of the present invention and is characterized in that the address converting circuit 21 shown in the circuit diagram of FIG. 4 is arranged in the liquid crystal display converter.

Therefore, the added address converting circuit 21 shown in FIG. 4 and arranged in the second construction of the present invention will next be explained in detail.

As clearly seen from FIG. 4, the address converting circuit 21 is arranged between a write address generating section 2 and an address generating circuit 24 for providing an address to a first frame memory 25 or a second frame memory 26. The address converting circuit 21 has a function for converting a write address such that continuous addresses in a certain reading operation can be read two times every cycle.

Figure 9:
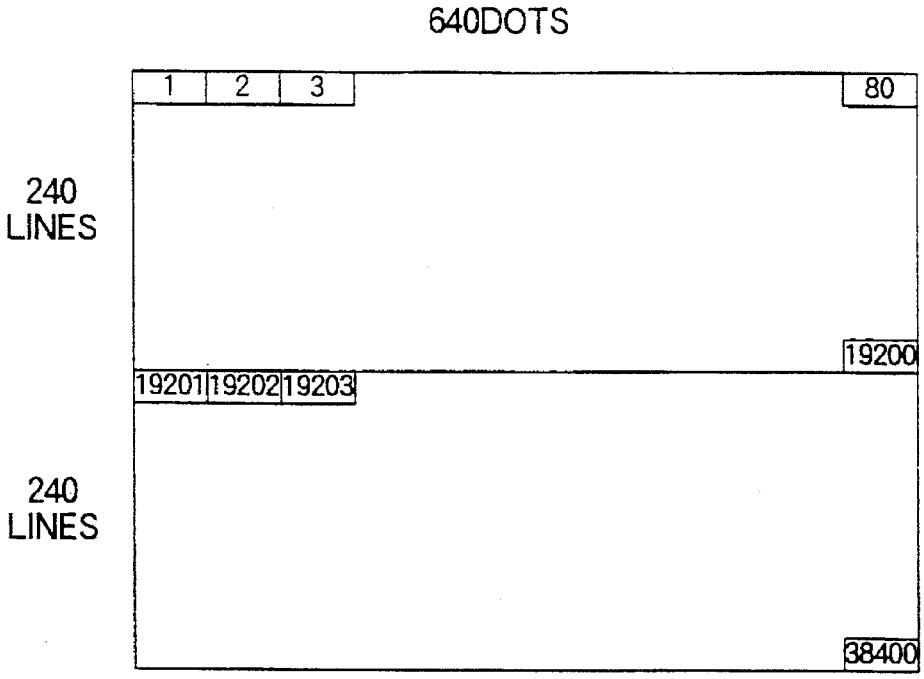
FIG. 9 is a view showing one example of addresses on a liquid crystal display panel in which numbers in FIG. 9 show addresses.

FIG. 9 is a view showing one example of addresses on a liquid crystal display panel. Numbers in FIG. 9 show addresses.

In the example of FIG. 9, one screen of the liquid crystal display panel (LCD) has 640 dots in a transversal direction and 480 lines in a longitudinal direction. This screen is divided into two divisional screens composed of upper and lower divisional screens. Each of the upper and lower divisional screens has 240 lines in the longitudinal direction.

In this example, one address includes data of 8 bits.

As shown in FIG. 9, addresses on one screen of the LCD are started and numbered from an upper left-hand corner thereof toward a right-hand direction. These addresses are also sequentially numbered from the left-hand side toward the right-hand direction on subsequent lines. Thus, a total of 38,400 addresses of 1, 2, 3, - - - , 80, - - - , 19200, 19201, 19202, 19203, - - - , 38400 is provided. Numbers from 1 to 19200 are provided on the upper divisional screen and numbers from 19201 to 38400 are provided on the lower divisional screen.

In a two-divisional driving system, it is necessary to simultaneously transfer data at the same address on the upper and lower divisional screens when these data are read.

Therefore, it is necessary to read these data in a combination such as addresses "1" and "19201", addresses "2" and "19202", addresses "3" and "19203", - - - in one cycle.

When a dynamic RAM (called a DRAM in the following description) having a single port is used, two addresses are separated from each other so that each of RAS and CAS must be provided two times in one cycle.

This relation will next be explained with reference to FIGS. 10 and 11*a* through 11*f*.

Figure 10:
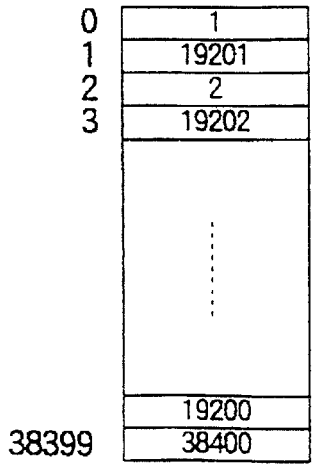
FIG. 10 is a view showing one embodiment of an address space of a first frame memory 25 shown in FIG. 4.

FIG. 10 is a view showing one embodiment of an address space of the first frame memory 25 shown in FIG. 4. A number within each of the columns in FIG. 10 shows an address on the screen and left-hand numbers outside the columns show addresses of the frame memory.

As shown in FIG. 10, a page mode of the DRAM can be used if these addresses are provided such that continuous read data are written to continuous addresses of one of the frame memories such as the first frame memory 25.

Each of FIGS. 11*a* and 11*f* is a timing chart showing operational timings of the frame memory shown in FIG. 10. FIGS. 11*a*, 11*b* and 11*c* shows one example of a general access operation in one cycle (n). FIGS. 11*d*, 11*e* and 11*f* shows one embodiment of an access operation of the liquid crystal display converter in the present invention.

As shown in FIG. 9, two addresses are separated from each other when display data corresponding to each of the screens are stored to a separate memory. At this time, when data are read from each of the frame memories, each of RAS and CAS must be provided two times in one cycle (n) in a general access method as shown in FIGS. 11*a*, 11*b* and 11*c*.

However, if the above addresses are provided such that data are written to continuous addresses of each of the frame memories as shown by the left-hand numbers outside the columns in FIG. 10, a high speed mode of the liquid crystal display converter can be used by providing RAS one time and CAS two times in one cycle (n) in a page mode as shown in FIGS. 11*d*, 11*e* and 11*f*. Accordingly, it is not necessary to use an expensive memory operated at a high speed.

The address converting circuit 21 shown in FIG. 4 has a function for generating addresses such that data are written to such continuous addresses of each of the frame memories.

Accordingly, in accordance with the second construction of the present invention, it is possible to provide a liquid crystal display converter in which high speed processing can be performed by using at least two frame memories having a processing speed similar to that in the general liquid crystal display converter.

As mentioned above, in the liquid crystal display converter having the first construction of the present invention, a plurality of frame memories such as the frame memories 25 and 26 in FIG. 4 perform only one of reading and writing operations in each of operating cycles of an LCD.

Accordingly, the number of access operations of the frame memories is reduced and the liquid crystal display converter can be constructed by a memory relatively cheaply manufactured without using any high speed memories. Therefore, the price of the liquid crystal display converter can be reduced.

In the liquid crystal display converter having the second construction of the present invention, an address converting circuit such as the address converting circuit 21 shown in FIG. 4 is added to the liquid crystal display converter having the first construction.

Accordingly, a high speed mode of a memory can be used so that a cheaply manufactured memory can be used in addition to the effects of the liquid crystal display converter having the first construction. Therefore, the price of the liquid crystal display converter can be further reduced.

Further, it is possible to cope with a situation in which a transfer clock signal of the LCD is transmitted at a high speed. Accordingly, performance of the liquid crystal display converter can be improved.

Figure 12:
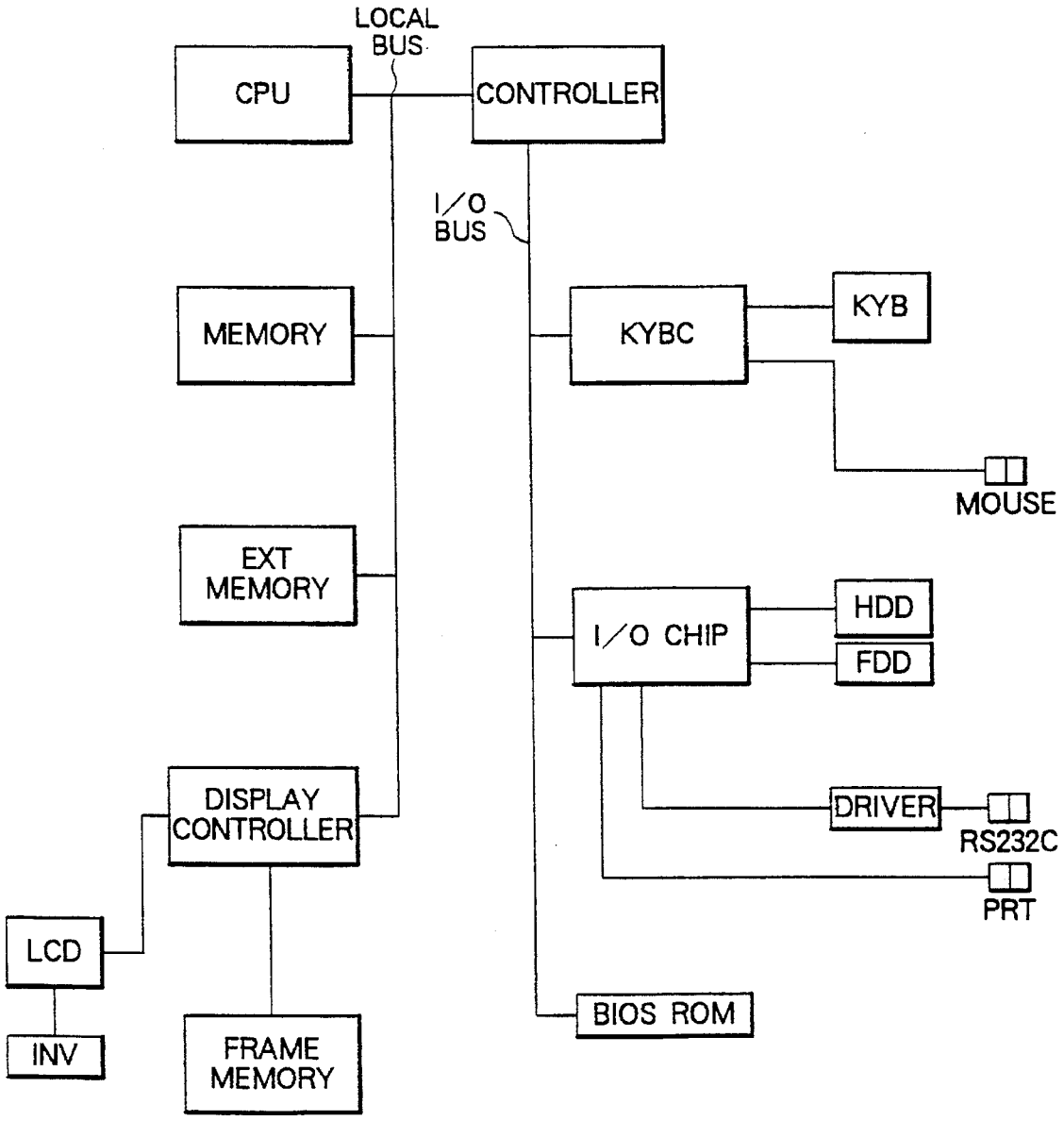
FIG. 12 is a block diagram showing one example of an information processor such as a personal computer using the liquid crystal display converter of the present invention.

FIG. 12 is a block diagram showing one example of an information processor such as a personal computer using the liquid crystal display converter of the present invention. In FIG. 12, this information processor has a central processing unit (CPU), a memory, an extended memory (EXT memory), a display controller, a frame memory, an LCD, an inverter INV for turning on a back light, another controller, a keyboard KYB, a keyboard controller KYBC for controlling an operation of the keyboard, a mouse connected to the keyboard controller, an I/O chip connected to HDD, FDD, a driver, etc., a BIOS ROM, etc. These constructional members are connected to each other through a local bus and an I/O bus, etc. The display controller and the frame memory in this information processor use the liquid crystal display converter of the present invention. Accordingly, the above effects of the liquid crystal display converter in the present invention can be also obtained in this information processor.

Many widely different embodiments of the present invention may be constructed without departing from the spirit and scope of the present invention. It should be understood that the present invention is not limited to the specific embodiments described in the specification, except as defined in the appended claims.

What is claimed is:

1. A liquid crystal display converter in a liquid crystal display unit having a display panel having divided display regions;

the liquid crystal display converter comprising:

at least two frame memories having an address space corresponding to one screen;

a frame counter for counting a number of pixels on the screen of said liquid crystal display unit;

an address generating circuit for generating an address of each of said at least two frame memories; and a data switching circuit for controlling data from each of said frame memories;

the liquid crystal display converter being constructed such that an alternative switching operation is performed by controlling operations of the address generating circuit and the data switching circuit on the basis of an output from said frame counter;

the alternative switching operation being set such that, when one of said frame memories performs a writing operation, the other frame memory performs a reading operation; and when one of said frame memories performs a reading operation, the other frame memory performs a writing operation;

wherein the liquid crystal display converter further comprises an address converting circuit for converting a write address such that respective data corresponding to the same position between the divided display regions are written to adjacent addresses of the frame memories; and an operation of the address converting circuit is controlled such that the adjacent addresses are continuously read at a reading time of said frame memories.

2. An information processor using a liquid crystal display converter in a liquid crystal display unit having a display panel having divided display regions;

the liquid crystal display converter comprising:

at least two frame memories having an address space corresponding to one screen;

a frame counter for counting a number of pixels on the screen of said liquid crystal display unit;

an address generating circuit for generating an address of each of said at least two frame memories; and a data switching circuit for controlling data from each of said frame memories;

the liquid crystal display converter being constructed such that an alternative switching operation is performed by controlling operations of the address generating circuit and the data switching circuit on the basis of an output from said frame counter;

the alternative switching operation being set such that, when one of said frame memories performs a writing operation, the other frame memory performs a reading operation; and when one of said frame memories performs a reading operation, the other frame memory performs a writing operation;

wherein the liquid crystal display converter further comprises an address converting circuit for converting a write address such that respective data corresponding to the same position between the divided display regions are written to adjacent addresses of the frame memories; and an operation of the address converting circuit is controlled such that the adjacent addresses are continuously read at a reading time of said frame memories.

3. The liquid crystal display device according to claim 1, wherein the address generating circuit comprises first and second switches controlled by the output from said frame counter.

4. The liquid crystal display device according to claim 3, further comprising an inverter connected to one of first and second switches for inverting the output from said frame counter.

5. The liquid crystal display device according to claim 1, wherein the data switching circuit comprises first, second, third and fourth buffers, the first and third buffers controlling outputting of writing data respectively to the two frame memories and the second and fourth buffers controlling outputting of reading data of the respective two frame memories.

6. The liquid crystal display device according to claims 2, wherein the address generating circuit comprises first and second switches controlled by the output from said frame counter.

7. The liquid crystal display device according to claim 6, further comprising an inverter connected to one of first and second switches for inverting the output from said frame counter.

8. The liquid crystal display device according to claim 2, wherein the data switching circuit comprises first, second, third and-fourth buffers, the first and third buffers controlling outputting of writing data respectively to the two frame memories and the second and fourth buffers controlling outputting of reading data of the respective two frame memories.

9. A liquid crystal display converter in a liquid crystal display unit having a display panel having divided display regions;

the liquid crystal display converter comprising:

at least two frame memories having an address space corresponding to one screen;

a frame counter for counting a number of pixels on the screen of said liquid crystal display unit and for outputting a frame selecting signal;

an address generating circuit for receiving the frame selecting signal and for generating an address of each of said at least two frame memories based on the frame selecting signal; and a data switching circuit for receiving the frame selecting signal and for controlling data from each of said frame memories based on the frame selecting signal;

the liquid crystal display converter being constructed such that an alternative switching operation is performed by controlling operations of the address generating circuit and the data switching circuit on the basis of the frame selecting signal output from said frame counter;

the alternative switching operation being set such that, when one of said frame memories performs a writing operation, the other frame memory performs a reading operation; and when one of said frame memories performs a reading operation, the other frame memory performs a writing operation.

10. A liquid crystal display converter as claimed in claim 9, wherein the liquid crystal display converter further comprises an address converting circuit for converting a write address such that respective data corresponding to the same position between the divided display regions are written to adjacent addresses of the frame memories; and an operation of the address converting circuit is controlled such that the adjacent addresses are continuously read at a reading time of said frame memories.

11. The liquid crystal display device according to claim 9, wherein the address generating circuit comprises first and second switches controlled by the frame selecting signal.

12. The liquid crystal display device according to claim 11, further comprising an inverter connected to one of first and second switches for inverting the frame selecting signal.

13. The liquid crystal display device according to claim 9, wherein the data switching circuit comprises first, second, third and fourth buffers, the first and third buffers controlling outputting of writing data respectively to the two frame memories and the second and fourth buffers controlling outputting of reading data of the respective two frame memories.

14. An information processor using a liquid crystal display converter in a liquid crystal display unit having a display panel having divided display regions;

the liquid crystal display converter comprising:

at least two frame memories having an address space corresponding to one screen;

a frame counter for counting a number of pixels on the screen of said liquid crystal display unit and for outputting a frame selecting signal;

an address generating circuit for receiving the frame selecting signal and for generating an address of each of said at least two frame memories based on the frame selecting signal; and a data switching circuit for receiving the frame selecting signal and for controlling data from each of said frame memories based on the frame selecting signal;

the liquid crystal display converter being constructed such that an alternative switching operation is performed by controlling operations of the address generating circuit and the data switching circuit on the basis of the frame selecting signal output from said frame counter;

the alternative switching operation being set such that, when one of said frame memories performs a writing operation, the other frame memory performs a reading operation; and when one of said frame memories performs a reading operation, the other frame memory performs a writing operation.

15. An information processor as claimed in claim 14, wherein the liquid crystal display converter further comprises an address converting circuit for converting a write address such that respective data corresponding to the same position between the divided display regions are written to adjacent addresses of the frame memories; and an operation of the address converting circuit is controlled such that the adjacent addresses are continuously read at a reading time of said frame memories.

16. The liquid crystal display device according to claim 14, wherein the address generating circuit comprises first and second switches controlled by the frame selecting signals output from the frame counter.

17. The liquid crystal display device according to claim 16, further comprising an inverter connected to one of first and second switches for inverting the frame selecting signal.

18. The liquid crystal display device according to claim 14, wherein the data switching circuit comprises first, second, third and fourth buffers, the first and third buffers controlling outputting of writing data respectively to the two frame memories and the second and fourth buffers controlling outputting of reading data of the respective two frame memories.

* * * * *